US009218930B2

(12) United States Patent
Xi et al.

(10) Patent No.: US 9,218,930 B2
(45) Date of Patent: Dec. 22, 2015

(54) CONTACT STRUCTURE OF LOW-VOLTAGE ELECTRICAL APPARATUS

(71) Applicants: SEARI ELECTRIC TECHNOLOGY CO., LTD., Shanghai (CN); ZHEJIANG CHINT ELECTRICS CO., LTD., Yueqing, Zhejiang (CN)

(72) Inventors: Hong Xi, Shanghai (CN); Feng Jia, Shanghai (CN); Ping Zeng, Shanghai (CN); Changxun Gu, Shanghai (CN)

(73) Assignees: SEARI ELECTRIC TECHNOLOGY CO., LTD., Shanghai (CN); ZHEJIANG CHINT ELECTRICS CO., LTD., Shanghai (CN)

( * ) Notice: Subject to any disclaimer, the term of this patent is extended or adjusted under 35 U.S.C. 154(b) by 37 days.

(21) Appl. No.: 14/368,948

(22) PCT Filed: Dec. 25, 2012

(86) PCT No.: PCT/CN2012/087396

§ 371 (c)(1),
(2) Date: Aug. 15, 2014

(87) PCT Pub. No.: WO2013/097698

PCT Pub. Date: Jul. 4, 2013

(65) Prior Publication Data

US 2015/0091678 A1 Apr. 2, 2015

(30) Foreign Application Priority Data

Dec. 26, 2011 (CN) ..... 2011 1 0441884

(51) Int. Cl.
*H01H 5/06* (2006.01)
*H01H 50/56* (2006.01)

(Continued)

(52) U.S. Cl.
CPC ..... *H01H 50/56* (2013.01); *H01H 1/20* (2013.01); *H01H 5/06* (2013.01); *H01H 50/18* (2013.01); *H01H 50/54* (2013.01)

(58) Field of Classification Search
CPC . H01H 5/06–5/12; H01H 50/56; H01H 50/58
See application file for complete search history.

(56) References Cited

U.S. PATENT DOCUMENTS

| | | | | |
|---|---|---|---|---|
| 4,421,959 | A | 12/1983 | Chen et al. | |
| 5,163,175 | A | 11/1992 | Mori et al. | |
| 2010/0258413 | A1 * | 10/2010 | Leischner | H01H 19/64 200/11 R |

FOREIGN PATENT DOCUMENTS

| | | | |
|---|---|---|---|
| CN | 1205111 | A | 1/1999 |
| CN | 1207201 | A | 2/1999 |

(Continued)

OTHER PUBLICATIONS

Official Action dated Aug. 28, 2014, issued by the State Intellectual Property Office of the People's Republic of China in related Chinese Patent Application No. 201110441884.0, with a partial English translation of its Search Report (7 pages).

(Continued)

*Primary Examiner* — Ramon Barrera
(74) *Attorney, Agent, or Firm* — Osha Liang LLP

(57) ABSTRACT

The present invention discloses a contact structure of a low-voltage electrical apparatus. The contact structure is in a dual-breakpoint form, and comprises: two U-shaped static contacts, the U-shaped static contact enabling the current direction in the static contact to be opposite to the current direction in a movable contact; a contact bridge; two movable contacts, disposed on the contact bridge, and respectively corresponding to the two static contacts; a contact support member, disposed on the movable contacts and connected to the movable contacts; two main contact springs, symmetrically disposed under the movable contacts and forming an angle with the contact bridge; and a spring support member, disposed under the two movable contacts and connected to the two main contact springs. At a contact position of the static contact and the movable contact and at a repulsed open position of the static contact and the movable contact, the angle between the main contact spring and the contact bridge is between $-\beta$ and $+\alpha$.

8 Claims, 5 Drawing Sheets

(51) Int. Cl.

| | |
|---|---|
| ***H01H 1/20*** | (2006.01) |
| ***H01H 50/18*** | (2006.01) |
| ***H01H 50/54*** | (2006.01) |

(56) References Cited

FOREIGN PATENT DOCUMENTS

| | | | |
|---|---|---|---|
| CN | 2340081 | Y | 9/1999 |
| CN | 2394314 | Y | 8/2000 |
| CN | 1378699 | A | 11/2002 |
| CN | 1405818 | A | 3/2003 |
| CN | 2733556 | Y | 10/2005 |
| CN | 101217076 | A | 7/2008 |
| CN | 101494143 | A | 7/2009 |
| CN | 101924344 | A | 12/2010 |
| DE | 102007013572 | A1 | 10/2008 |
| EP | 0 437 220 | A2 | 7/1991 |

OTHER PUBLICATIONS

International Search Report mailed Apr. 4, 2013, in corresponding International Application No. PCT/CN2012/087396, with English translation (4 pages).

2nd Office Action issued Apr. 3, 2015, by the State Intellectual Property Office of the People's Republic of China, in corresponding Chinese Patent Application No. CN-201110441884.0, with partial English translation of the Search Report contained therein (7 pages).

Official Action dated Sep. 2, 2014, issued by The State Intellectual Property Office of The People's Republic of China in related Chinese Patent Application No. CN 201110442031.9, with a partial English translation of its Search Report (9 pages).

* cited by examiner

CONTACT STRUCTURE OF LOW-VOLTAGE ELECTRICAL APPARATUS

BACKGROUND OF INVENTION

1. Field of Invention

The present invention relates to the field of low-voltage electrical apparatus, and more particularly, to a contact structure of low-voltage electrical apparatus.

2. Related Art

Low-voltage electrical apparatuses may be categorized into distribution electrical apparatuses and control electrical apparatuses in accordance with their position and functions in the electric circuits. Both the distribution electrical apparatus and the control electrical apparatus have a contact system disposed therein. As a fundamental element of a low-voltage electrical apparatus, the contact system directly affects the performance of the apparatus.

Low-voltage circuit breakers are major products in distribution electrical apparatuses. Short-circuit breaking ability is a primary performance index of a low-voltage circuit breaker. When a short-circuit fault occurs in a circuit, the faster a contact of the breaker opens, the better the current-limiting performance is, a better current-limiting performance will greatly reduce the negative effects to the breaker and electrical apparatuses that were caused by short-circuit current and extends the lifetime of the breaker. Contactors are major products in control electrical apparatuses. In addition to frequently closing and breaking rated current, a contactor may also close, break, and carry rated overload current. Therefore, it is desired that a contact of a contactor may bear high mechanical and electrical lifetime. The faster a contact opens, the fewer electric arc is resulted, then fewer burnings is brought to the contact and the lifetime of the contactor may be longer. Control-and-protection switching apparatuses have similar demands on the contact as the breakers when breaking short-circuit current. And, control-and-protection switching apparatuses have similar demands on the contact as the contactors when performing frequent operations.

Contact structures commonly used in the low-voltage breakers have two forms, one is single-breakpoint form and the other is dual-breakpoint form. The dual-breakpoint form further includes translational form and rotational form. A contact structure in a dual-breakpoint translational form will rebound after the contact is repulsed. Therefore, a contact in a dual-breakpoint translational form is usually used in situations with a smaller rated current, or situations that have fewer demands on the protection of short-circuit current. For example, an existing breaker with 32 A or lower rated current has a contact of a dual-breakpoint translational form, and its short-circuit breaking ability (lcs) is generally 50 kA. A breaker with 50 A rated current has a contact structure of a dual-breakpoint translational form, and its short-circuit breaking ability (lcs) is generally 30 kA.

A contactor, as a frequently operated electrical apparatus, has demands on high operating frequency and relatively longer mechanical and electrical lifetime. An actuator of a contactor is usually driven by an electromagnet. Since the contactor itself does not have the ability of breaking short-circuit current, a short-circuit protection apparatus is necessarily disposed in the circuits, and the contactor and the short-circuit protection apparatus needs to be coordinated. When the contact of the contactor is closed, electric arcs generated by contact rebounding will burn the contact and shorter its lifetime. By increasing the pressure of the contact, adverse effects caused by electric repulsion force and the secondary rebounding of the contact may be decreased. However, the increase of contact pressure will increase the attraction force of the electromagnet, and thus will increase the volume of the contactor. Meanwhile, the increase of contact pressure will have increased demands on the mechanical performances of structure members and main springs, resulting in increased product costs.

A control-and-protection switching electrical apparatus, as a multi-functional electrical apparatus, has both short-circuit protection of a breaker and high operating frequency and relatively higher mechanical/electrical lifetime of a contactor. A control-and-protection switching electrical apparatus may be designed integrally or modularly, such a control-and-protection switching electrical apparatus facilitates coordination between a contactor and a short-circuit protection apparatus due to the usage of one set of contactor system and control system. However, the contactor system shall simultaneously meet the needs of both high short-circuit breaking ability of a breaker and high operating frequency and high mechanical, electrical lifetime of a contactor since it shall have functions of both the breaker and the contactor. The design of the apparatus in an existing product uses a contact system similar to a contactor, that is, the contact system utilizes a dual-breakpoint bridge type contact, which results in following adverse effect. When the contacts are repulsed by electric repulsion force generated under large current, the contacts usually rebound quickly, such a condition lasts until the operating mechanism completes a tripping operation. The contacts are damaged with burnings caused by repeated close/open of the contacts, so that its usage lifetime is shortened. Therefore, a set of contact blocking mechanisms shall be specially designed. If the contact system is in single-breakpoint or dual-breakpoint rotational form of a breaker, short-circuit breaking ability may be greatly increased but high operating frequency and high mechanical and electrical lifetime cannot be achieved, and thus cannot meet the overall demand of the control-and-protection switching electrical apparatus. The existing integrally or modularly designed control-and-protection switching electrical apparatus utilizes a contact system of a dual-breakpoint translational form, and has relatively smaller scale capacity. For large-scale products, a combination form of separate components is utilized.

SUMMARY

The present invention provides a novel contact structure of a low-voltage electrical apparatus.

According to an embodiment of the present invention, a novel contact structure of a low-voltage electrical apparatus is provided. The contact structure is in a dual-breakpoint form, the contact structure comprises:

two U-shaped static contacts, the U-shaped static contact enabling the current direction in the static contact to be opposite to the current direction in a movable contact;

a contact bridge;

two movable contacts, disposed on the contact bridge, and respectively corresponding to the two static contacts;

a contact support member, disposed on the movable contacts and connected to the movable contacts;

two main contact springs, symmetrically disposed under the movable contacts and forming an angle with the contact bridge; and a spring support member, disposed under the two movable contacts and connected to the two main contact springs, wherein, at a contact position of the static contact and the movable contact and at a repulsed open position of the static contact and the movable contact, the angle between the main contact spring and the contact bridge is between $-\beta$ and $+\alpha$, wherein $\beta$ may be equal to $\alpha$, or $\beta$ may be different with $\alpha$.

In an embodiment, the main contact spring is a compression spring or a tension spring.

In an embodiment, the contact structure of a low-voltage electrical apparatus further comprises a reset mechanism disposed on the contact bridge.

In an embodiment, the contact structure is applied to a breaker, when the contact normally opens, the angle between the main contact spring and the contact bridge is between $+\alpha$ to 0°, when breaking short-circuit currents, the static contacts are repulsed from the movable contacts, and the angle between the main contact spring and the contact bridge is inversed to $-\beta$, the main contact spring applies a downward spring force to the movable contacts so as to keep the static contacts and the movable contacts at an open distance.

In an embodiment, the reset mechanism resets the static contacts and the movable contacts to a normal open position.

In an embodiment, the contact structure is applied to a contactor, when the contact normally opens, the angle between the main contact spring and the contact bridge is between $+\alpha$ to 0°, when the angle between the main contact spring and the contact bridge is $+\alpha$, an upward force is applied to the movable contacts by the main contact spring to make the movable contacts and the static contacts close, the upward force is maximum when the angle is $+\alpha$, when the angle between the main contact spring and the contact bridge changes from $+\alpha$ to 0°, the upward force applied to the movable contacts by the main contact spring decreases gradually.

In an embodiment, the reset mechanism resets the static contacts and the movable contacts to a normal open position.

In an embodiment, when the main contact spring forms an angle of 0° with the contact bridge, the two main contact springs are in a straight line, and the contact structure is at a dead center position.

The contact structure of low-voltage electrical apparatuses of the present invention may allow a repulsed open distance of the contact to be two times larger than a normal open distance. A large open distance between movable contacts and static contacts is advantageous to the extinction of electric arcs, and may greatly enhance short-circuit breaking ability of breakers. Reset mechanisms may be used to reset the contact to a normal open position. The contact structure of low-voltage electrical apparatuses of the present invention may meet the design requirements on high short-circuit breaking ability, high operating frequency, and high mechanical and electrical lifetime of control-and-protection switching electrical apparatuses.

BRIEF DESCRIPTION OF THE DRAWINGS

The above and other features, natures, and advantages of the invention will be apparent by the following description of the embodiments incorporating the drawings, wherein, FIG. 1*a* is a contact of a single-breakpoint form, FIG. 1*b* is a contact of a dual-breakpoint rotational form, and FIG. 1*c* is a contact of a dual-breakpoint translational form.

DETAILED DESCRIPTION OF EMBODIMENTS

Figure 1A:
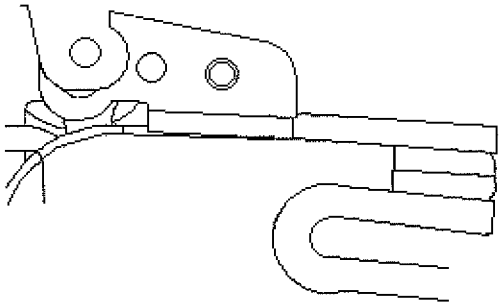
FIGS. 1*a*, 1*b*, and 1*c* illustrate diagrams of contact structures commonly used in low-voltage electrical apparatuses in the prior art, where
Figure 1B:
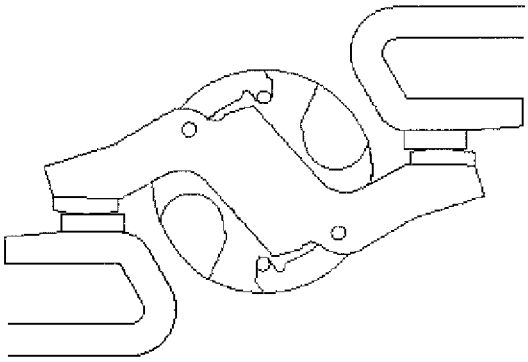
Figure 1C:
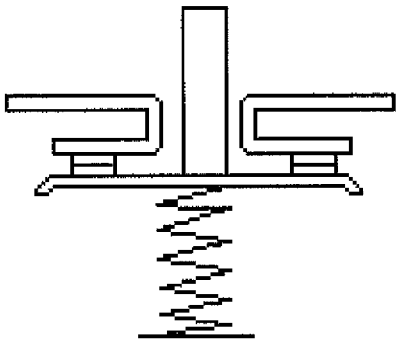

In order to address the deficiencies existed in prior art, the present invention provides a contact structure adapted for use in a low-voltage electrical apparatus, and especially adapted for use in a control-and-protection switching electrical apparatus that has both functions of a contactor and a breaker. The present invention may not only meet the demand of high short-circuit breaking ability, but also meet the need of high operating frequency and high mechanical and electrical lifetime.

The contact structure of a low-voltage electrical apparatus in accordance with the present invention is in a dual-breakpoint form, and comprises: two U-shaped static contacts, a contact bridge, two movable contacts, a contact support member, two main contact springs, and a spring support member. The U-shaped static contact enables the current direction in the static contact to be opposite to the current direction in a movable contact. The two movable contacts are disposed on the contact bridge, and respectively correspond to the two static contacts. The contact support member is disposed on the movable contacts and is connected to the movable contacts. The two main contact springs are symmetrically disposed under the movable contacts and form an angle with the contact bridge. The spring support member is disposed under the two movable contacts and is connected to the two main contact springs. At a contact position of the static contact and the movable contact and at a repulsed open position of the static contact and the movable contact, the angle between the main contact spring and the contact bridge is between $-\beta$ and $+\alpha$, where $\beta$ may be equal to $\alpha$, or $\beta$ may be different with $\alpha$. The contact structure of the low-voltage electrical apparatus further comprises a reset mechanism, which is disposed on the contact bridge.

The arrangement of the main contact springs in the contact structure of the low-voltage electrical apparatus of the present invention is different to that inprior art. In prior art, a main contact spring of the contact structure in a dual-breakpoint translational form is disposed under a contact bridge of movable contacts and form an angle of 90° with the contact bridge of movable contacts. The main spring is usually a compression spring. A P1 force of the spring is a contact pressure of the contact that makes movable contacts and static contacts close. A P2 force of the spring is a counterforce when movable contact and static contact are open, the P2 force should be overcome with a force of an operation mechanism or a counterforce spring of an electromagnet so as to maintain the movable contact and static contact as an open state. Since a main spring is generally a cylinder compression spring, the P2 force of the spring is larger than the P1 force, and the spring force increases linearly. On the other hand, the operation mechanism force, especially the force formed by the counterforce spring of an electromagnet, decreases linearly according to the stroke. In other words, the larger a stroke of the contact or the larger an open distance of the contact is, the larger a required operational force is. While the larger a stroke of the contact or the larger an open distance of the contact is, the smaller the operation mechanism force or the counterforce of an electromagnet (i.e., an actual operational force) is. A breaker, due to its demand on relatively high short-circuit breaking ability, generally utilizes an electric repulsion force to repulse the contact and designs a relatively large open distance of the contact so as to facilitate the extinction of electric arcs. Since the spring force of the main contact increases linearly, the main spring force on the operation mechanism shall be designed to be relatively large so as to achieve a relatively large operational force, which is disadvantageous to the design or the operation mechanism. To meet the demand of manual operational force, the designed size of the mechanism shall be satisfied, e.g., to increase a leverage ratio, which is disadvantageous to miniaturization of electrical apparatuses. For a contact structure in a dual-breakpoint translational form, after the contact is repulsed with an electric repulsion force, the contact will rebound if not clamped by a special mechanism, and repeated close/open of the contacts will heavily damage the contacts with burnings and shorten its lifetime. According to the characteristic of the suction/counter force of an electromagnet, the stroke of the electromagnet is directly related to the suction/counter force of the electromagnet. The suction force is larger at a smaller stroke, while the suction force is smaller at a larger stroke, and a larger counter force is needed at a larger stroke while a smaller counter force is needed at a smaller stroke. When the open distance of contacts is enlarged, a counterforce spring of an electromagnet must be enlarged, and thus the designed size of the electromagnet shall be enlarged and the vibration force generated when the contacts are sucked together will be enlarged as well. The vibration force may easily burn the contact and shorten the lifetime of the switching apparatus. Therefore, common contactors usually have smaller parameters for the open distance under the condition that the demand of electric performance is met.

In the contact structure of the low-voltage electrical apparatus of the present invention, a pair of main contact springs is disposed under a contact bridge and form an angle with the contact bridge. According to the relative position of static contacts and movable contacts, this angle varies between $-\beta$ and $+\alpha$. As mentioned above, $\beta$ may be configured as equal to or not equal to $\alpha$. Under the situation that the contact pressures are the same, the force of each spring in the pair of main contact springs is smaller than the force of a conventional contact spring, and is dependent upon the angle between the spring and the bridge. By adjusting the angle, parameters of a corresponding spring may be adjusted. The springs may be compression springs or tension springs, and the angle of the springs may vary. According to the demand of contact stroke, the springs may be configured to allow the contact structure be in dual-stable positions. The angle between a main contact spring and a contact bridge can differ from $+\alpha$ to 0° and then to $-\beta$. When the angle between the main contact spring and the contact bridge is $+\alpha$, the main contact spring applies an upward force to movable contacts so that both the movable contacts and the static contacts are in a closed position, which is one stable position. When the angle between the main contact spring and the contact bridge is $-\beta$, the movable contacts and the static contacts are in a repulsed open position, which is the other stable position. When the angle between the main contact spring and the contact bridge is 0°, the two springs are in a straight line and the contact structure is in a dead center position. Only when the contact is repulsed to a certain distance with an electric repulsion force formed by large current, the contact structure may reach the dead center position. Due to the effect of the electric repulsion force, the dead center position is an unstable position. When the spring crosses the dead center and inverse to $-\beta$, the other stable position is achieved.

When applying the contact structure of the low-voltage electric apparatus of the present invention to a breaker, the angle between the main contact spring and the contact bridge is between $+\alpha$ and 0° upon normal open of the contacts. When breaking short-circuit current, electric repulsion force may repulse movable contacts, and the angle between the main contact spring and the contact bridge is inversed to $-\beta$. The main contact spring applies a downward spring force to movable contacts so as to allow the movable contacts be in a stable state. Therefore, a large repulsed open distance between movable contacts and static contacts is derived so as to facilitate extinction of electric arcs and greatly increase short-circuit breaking ability of the breaker. A reset mechanism may be used to reset the contact to normal open position.

When applying the contact structure of the low-voltage electric apparatus of the present invention to a contactor, the angle between the main contact spring and the contact bridge is between $+\alpha$ and 0° upon normal open of the contacts. By adjusting parameters of the spring and the contact bridge, the main contact spring applies a maximum upward spring force to movable contacts when the angle between the main contact spring and the contact bridge is $+\alpha$ so as to make static contacts and the movable contacts close. When the angle between the main contact spring and the contact bridge varies from $+\alpha$ to 0°, the upward spring force applied by the main contact spring to movable contacts gradually decreases. In other words, the contact structure may be designed in the following manner: when the stroke of an electromagnet varies from 0 to an open distance required by the design, the force applied on the contact bridge decreases. The present invention overcomes the disadvantage of traditional contactors that the contact requires a larger counterforce when the stroke of the electromagnet is larger. The present invention facilitates miniaturization of the electromagnet, saves raw materials and costs, and greatly reduces the energy consumption of the electromagnet.

When the contact structure of low-voltage electrical apparatus of the present invention is applied to the situation of control-and-protection switching electrical apparatus, the aforesaid breaker and contactor that both utilizes a translational dual-breakpoint contact structure may be easily applied in control-and-protection switching electrical apparatus to achieve coordination of breaker functions and contactor functions. When functioning as a breaker, the contact structure of low-voltage electrical apparatus of the present invention may repulse the contact and make it stable at $-\beta$ position. A reset mechanism may be utilized to reset the contact to a normal open position. When the contact is in a normal open position, the angle between the main contact spring and the contact bridge is between $+\alpha$ to 0°. The parameters of the main contact spring and the contact bridge may be optimized based on both the demands of a breaker and a contactor. Open distances of open operations that are controlled by an operation mechanism and an electromagnet may be the same. Since the repulsed open distance of the contact may be two times larger than the normal open distance, design requirements of control-and-protection switching electrical apparatus may be met, such as high short-circuit breaking ability, high operating frequency, and high mechanical and electrical lifetime.

Figure 2A:
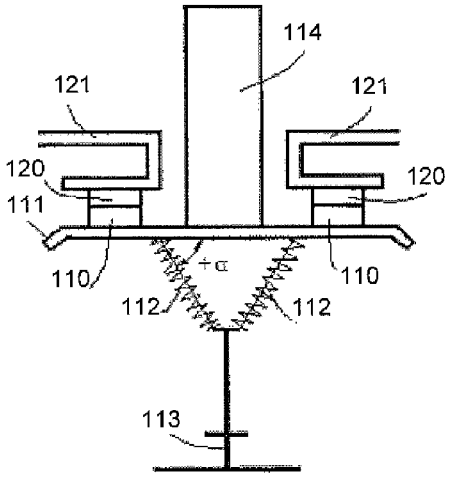
FIGS. 2*a*, 2*b*, 2*c*, and 2*d* illustrate diagrams of a contact structure of a low-voltage electrical apparatus according to an embodiment of the present invention.
Figure 2B:
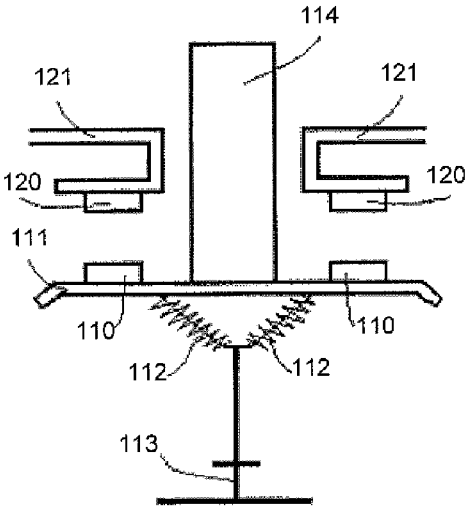
Figure 2C:
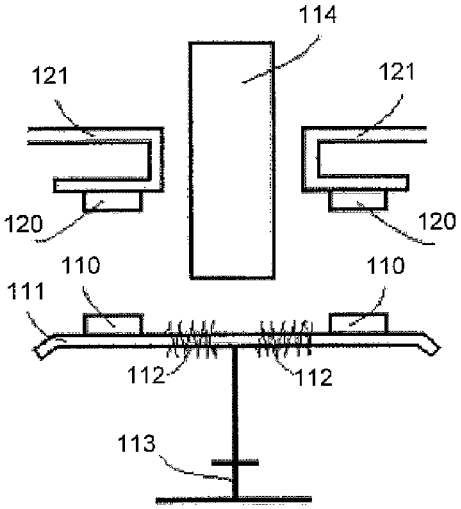
Figure 2D:
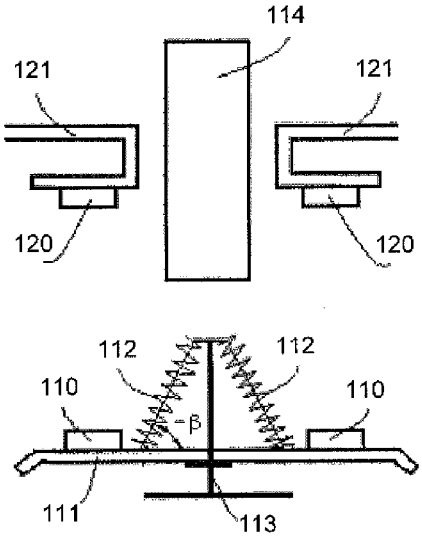
Figure 3A:
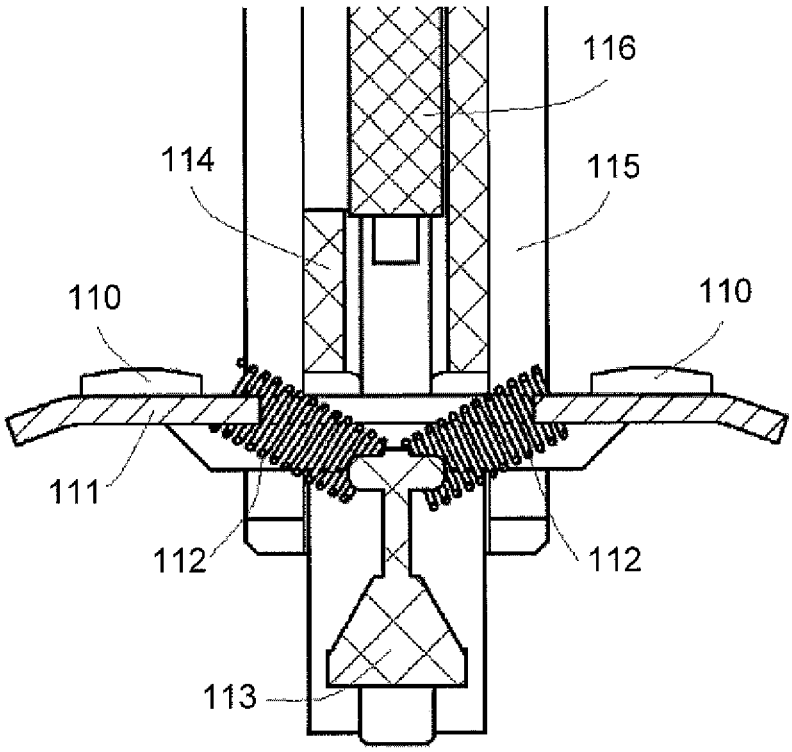
FIGS. 3*a* and 3*b* illustrate structures of a movable contact and a contact bridge portion in a contact structure of a low-voltage electrical apparatus according to an embodiment of the present invention.
Figure 3B:
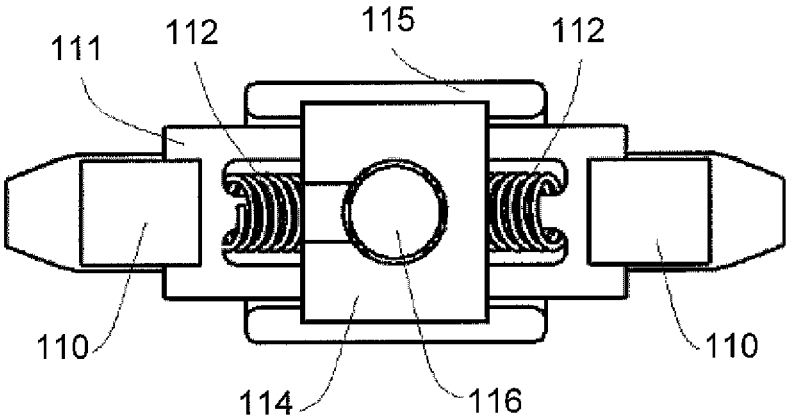

FIGS. 2 and 3 illustrate specific implementations of a contact structure of a low-voltage electrical apparatus according to an embodiment of the present invention. FIGS. 2*a*, 2*b*, 2*c*, and 2*d* illustrate diagrams of a contact structure of a low-voltage electrical apparatus according to an embodiment of the present invention. FIGS. 3*a* and 3*b* illustrate structures of a movable contact and a contact bridge portion in a contact structure of a low-voltage electrical apparatus according to an embodiment of the present invention.

As shown in FIGS. 2*a*, 2*b*, 2*c*, and 2*d*, the contact structure of the low-voltage electrical apparatus is in a dual-breakpoint form. The contact structure comprises two U-shaped static contact structures, a contact bridge 111, two movable contacts 110 connected to the contact bridge 111, a contact support member 114 disposed on the contact bridge 111 and associated with the movable contacts 110, two main contact springs 112, and a spring support member 113. More particularly, each static contact structure comprises a U-shaped conductive bar 121 and a static contact 120 connected to the conductive bar 121. The two main contact springs 112 are symmetrically disposed under the movable contacts 110 and form an angle with the contact bridge 111, where the angle varies between $-\beta$ and $+\alpha$. $\beta$ may be configured to be equal to or not equal to $\alpha$. The spring support member 113 is disposed under the contact bridge 111 and associated with the two main contact springs 112. As shown in FIGS. 3*a* and 3*b*, the contact structure further comprises reset mechanisms 115, 116 associated with the movable contacts 110 and the contact bridge 111.

Figure 4A:
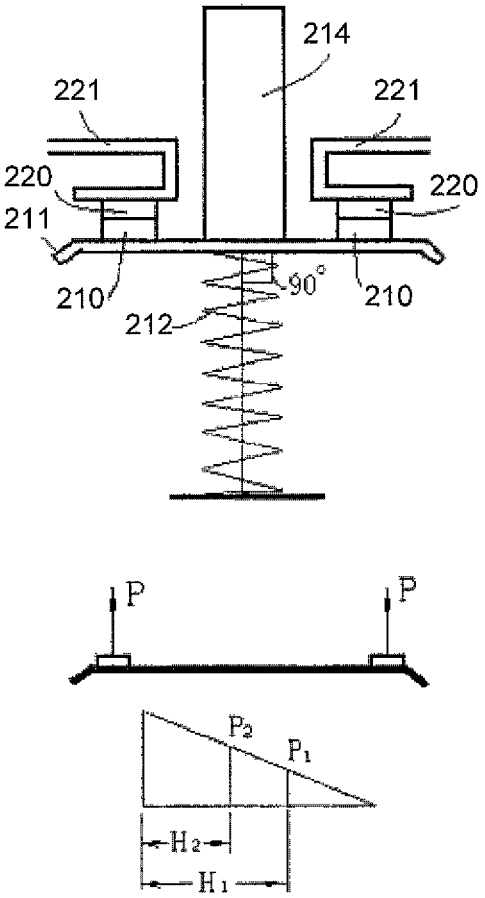
FIGS. 4*a*, 4*b*, 4*c*, and 4*d* illustrate force analysis diagrams of a contact structure of a low-voltage electrical apparatus according to an embodiment of the present invention.

The contact structure of the low-voltage electrical apparatus of the present invention may be applied to low-voltage electrical apparatuses, such as breakers, contactors, and may especially be used in control-and-protection switching electrical apparatuses which have functions of both breakers and contactors. FIG. 4*a* discloses a contact structure of a low-voltage electrical apparatus according to prior art. In this contact structure, a single main contact spring 212 is disposed. The single main contact spring 212 is disposed under a contact bridge 211 and forms an angle of 90° with the contact bridge 211. A P1 force of the main contact spring 212 is allocated to movable contacts 210 on both sides of the contact bridge 211. Therefore, the contact pressure on each of the movable contacts 210 and static contacts 220 is ½ P1 force. To open movable contacts 210 and static contacts 220, a P2 force of the main contact spring 212 shall be overcome. Since the main contact spring 212 is usually a cylinder compression spring, the P2 force of the main contact spring is larger than the P1 force of the spring, and linearly increases.

Figure 4B:
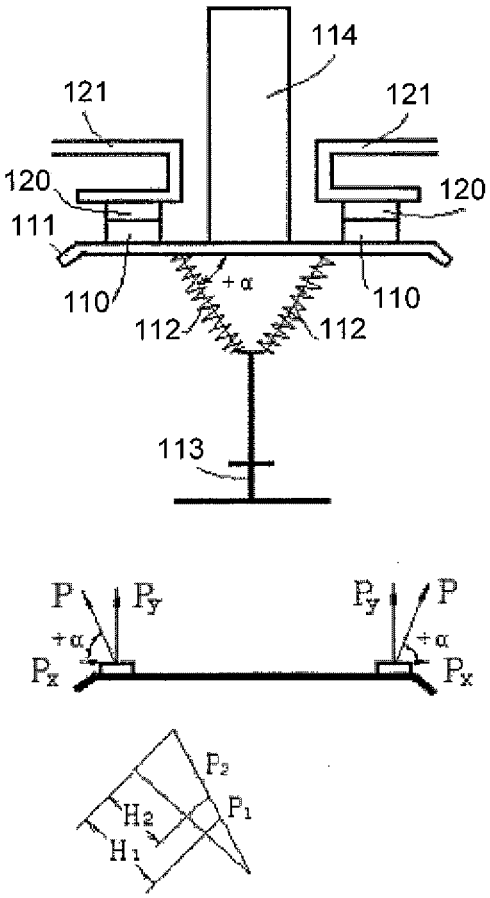
Figure 4C:
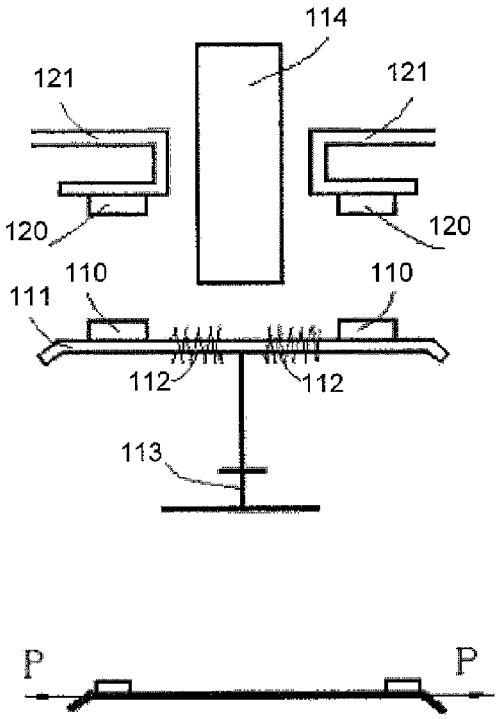
Figure 4D:
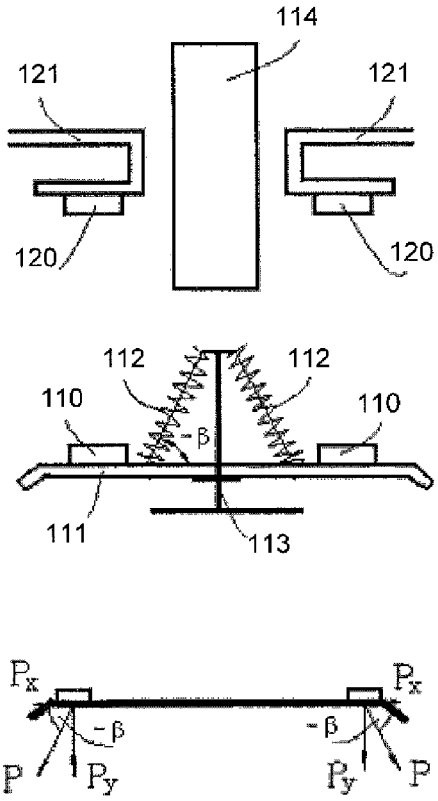

When the contact structure of the low-voltage electrical apparatus of the present invention is applied to control-and-protection electrical apparatuses (hereinafter "CPS"), the contact structure may be designed as follows. As shown in FIGS. 2*a*, 2*b*, 2*c*, and 2*d*, in a multi-polar CPS, a contact unit of each polar has a pair of main contact springs 112, which is disposed under a contact bridge 111 that has movable contacts 110 and forms an angle with the contact bridge 111, where the angle varies between $-\beta$ and $+\alpha$. $\beta$ may be configured to be equal to $\alpha$, or not equal to $\alpha$. An end of the main contact spring 112 is secured on the contact bridge 111, the other end of the main contact spring 112 is secured on a spring support member 113. The angle between the main contact spring 112 and the contact bridge 111 may vary between $-\beta$ and $+\alpha$. As shown in FIG. 4*b*, the contact pressure of movable contacts 110 and static contacts 120 is two times of Py. According to the design specification of product, the amount of the contact pressure may be configured by adjusting the angle $\alpha$ or adjusting parameters of the main contact spring 112. The main contact spring 112 may be designed as a compression spring. Normal open and close of CPS may be performed through an operation mechanism handle or a control electromagnet in the CPS. During normal open or close of the CPS, the angle $\alpha$ of the main contact spring 112 in the contact structure may vary. According to the requirement of the contact stroke, there is an angle $\alpha$ formed between the main contact spring 112 and the contact bridge 111. The angle $\alpha$ of a time when the movable contacts 110 and static contacts 120 are closed is shown in FIG. 2*a*. The angle $\alpha$ at a time when the movable contacts 110 and static contacts 120 are opened is shown in FIG. 2*b*. The distance between movable contacts 110 and static contacts 120 is the open distance of the contact. From these figures, it is obvious that the $\alpha$ shown in FIG. 2*b* is smaller than the $\alpha$ shown in FIG. 2*a*. Since the contact pressure is related to the Py force of the main contact spring 112, that is, the contact pressure when the contacts are closed is P1 sin $\alpha$, and the force required to open the contacts is P2 sin $\alpha$. Though the P2 force of the spring is larger than the P1 force of the spring, $\alpha$ is variable and the $\alpha$ under P1 is larger than the $\alpha$ under P2, it is possible to make the P2 sin $\alpha$ force be smaller than the P1 sin $\alpha$ force by optimization of design, such as adjusting parameters of the main contact spring 112 and the contact bridge 111 so that the amount of Py force may be changed and the Py force does not linearly increases with the decrease of $\alpha$. Thus, the spring force of the operation mechanism and the counter spring force of the control electromagnet may decrease, which may enhance the mechanism performance of the operation mechanism and reduce the volume of the electromagnet, so as to further reduce the volume of the CPS and enhance the mechanical operating performance and lifetime of CPS.

FIGS. 4*a*, 4*b*, 4*c*, and 4*d* illustrate force analysis diagrams of a contact structure of a low-voltage electrical apparatus according to an embodiment of the present invention. Both the operation mechanism and the control electromagnet in the CPS may control statuses of the CPS. Normal close and open of CPS is conducted by the control electromagnet in the CPS, i.e., the function of a contactor, which requires high operating frequency and long mechanical electrical lifetime. As shown in FIGS. 4*a*, 4*b*, 4*c*, and 4*d*, two main contact springs 112 are symmetrically disposed and form an angle therebetween. As mentioned above, the angle varies between $-\beta$ and $+\alpha$. Due to the distribution of forces, this structure is advantageous to the balance of the contact bridge 111. Further, compared to the configuration of a single spring, the force required by each of the springs in the two-spring configuration (FIG. 4*b*) is smaller than the force required by the single spring in FIG. 4*a*, which is advantageous to extend the lifetime of the spring and the requirement on the spring material is reduced.

Parameters of the springs may be configured as follows: during startup of CPS or carrying normal overload currents, the springs may prevent the contacts from repulsion. When breaking large currents caused by short-circuit, electric repulsion force formed by large currents will repulse the contacts to a certain distance, which may allow the contact bridge 111 which has movable contacts 110 to cross the dead center position of the contact structure as shown in FIG. 2*c*. In this situation, the Py force of the main contact spring 112 is inversely downward so as to allow the contact bridge 111 to arrive at a stable position as shown in FIG. 2*d*. The open distance between movable contacts 110 and static contacts 120 is much larger than the distance under normal close and open. For example, the open distance between movable contacts and static contacts may be two times larger than the distance under normal close and open.

Generally, the time that the electrical repulsion force repulses the contact is much faster than the time that the mechanism operates. The contact structure of the present invention is advantageous to short-circuit breaking performance because the contacts are repulsed to a very large open distance that is two times larger than the open distance under normal close and open. For example, for a CPS with a maximum rated current of 32 A, the short-circuit breaking ability Ics may be larger than 50 kA, or may be 60 kA or even lager. After breaking short-circuit current, reset mechanisms 115, 116 may be used to reset the contact bridge 111 to the position shown in FIG. 2*b* so that the CPS is in a normal operating status. CPS may also configure the position shown in FIG. 2*d* as an isolation position. A combination of the contact support member 114 and reset mechanisms 115, 116 in the structure may be used to implement isolation function.

The contact structure of low-voltage electrical apparatuses of the present invention may allow the repulsed open distance of the contacts to be two times larger than a normal open distance. A large open distance between movable contacts and static contacts is advantageous to the extinction of electric arcs, and may greatly enhance short-circuit breaking ability of breakers. Reset mechanisms may be used to reset the contact to a normal open position. The contact structure of low-voltage electrical apparatuses of the present invention may meet the design requirements on high short-circuit breaking ability, high operating frequency, and high mechanical and electrical lifetime of control-and-protection switching electrical apparatuses.

The above embodiments are provided to those skilled in the art to realize or use the invention, under the condition that various modifications or changes being made by those skilled in the art without departing the spirit and principle of the invention, the above embodiments may be modified and changed variously, therefore the protection scope of the invention is not limited by the above embodiments, rather, it should conform to the maximum scope of the innovative features mentioned in the Claims.

What is claimed is:

1. A contact structure of a low-voltage electrical apparatus, wherein the contact structure is in a dual-breakpoint form, the contact structure comprising:

two U-shaped static contacts, the U-shaped static contact enabling the current direction in the static contact to be opposite to the current direction in a movable contact;

a contact bridge;

two movable contacts, disposed on the contact bridge, and respectively corresponding to the two static contacts;

a contact support member, disposed on the movable contacts and connected to the movable contacts;

two main contact springs, symmetrically disposed under the movable contacts and forming an angle with the contact bridge; and a spring support member, disposed under the two movable contacts and connected to the two main contact springs, wherein, at a contact position of the static contact and the movable contact and at a repulsed open position of the static contact and the movable contact, the angle between the main contact spring and the contact bridge is between $-\beta$ and $+\alpha$.

2. The contact structure of a low-voltage electrical apparatus according to claim 1, wherein the main contact spring is a compression spring or a tension spring.

3. The contact structure of a low-voltage electrical apparatus according to claim 1, further comprising:

a reset mechanism disposed on the contact bridge.

4. The contact structure of a low-voltage electrical apparatus according to claim 3, wherein the contact structure is applied to breaker, when the contact normally opens, the angle between the main contact spring and the contact bridge is between $+\alpha$ to $0°$, when breaking short-circuit currents, the static contacts are repulsed from the movable contacts, and the angle between the main contact spring and the contact bridge is inversed to $-\beta$, the main contact spring applies a downward spring force to the movable contacts so as to keep the static contacts and the movable contacts at an open distance.

5. The contact structure of a low-voltage electrical apparatus according to claim 4, wherein the reset mechanism resets the static contacts and the movable contacts to a normal open position.

6. The contact structure of a low-voltage electrical apparatus according to claim 3, wherein the contact structure is applied to a contactor, when the contact normally opens, the angle between the main contact spring and the contact bridge is between $+\alpha$ to $0°$, when the angle between the main contact spring and the contact bridge is $+\alpha$, an upward force is applied to the movable contacts by the main contact spring to make the movable contacts and the static contacts close, the upward force is maximum when the angle is $+\alpha$, when the angle between the main contact spring and the contact bridge changes from $+\alpha$ to $0°$, the upward force applied to the movable contacts by the main contact spring decreases gradually.

7. The contact structure of a low-voltage electrical apparatus according to claim 6, wherein the reset mechanism resets the static contacts and the movable contacts to a normal open position.

8. The contact structure of a low-voltage electrical apparatus according to claim 1, wherein when the main contact spring forms an angle of $0°$ with the contact bridge, the two main contact springs are in a straight line, and the contact structure is at a dead center position.

* * * * *